US005891000A

United States Patent [19]

Phillips

[11] Patent Number: 5,891,000

[45] Date of Patent: Apr. 6, 1999

[54] PROCESS FOR MANUFACTURING FILLED DOUBLE BLADDER RESILIENT ARTICLES

[75] Inventor: Lester Phillips, Houston, Tex.

[73] Assignee: Gayla Industries, Inc., Houston, Tex.

[21] Appl. No.: 24,965

[22] Filed: Feb. 14, 1998

[51] Int. Cl.[6] ..... A63B 23/16

[52] U.S. Cl. ..... 482/49; 273/584

[58] Field of Search ..... 482/44, 49, 148; 446/267, 369; 273/63 E, 58 F, 584

[56] References Cited

U.S. PATENT DOCUMENTS

| | | | |
|---|---|---|---|
| 3,347,545 | 10/1967 | Nichols | 446/267 |
| 3,601,923 | 8/1971 | Rosenberg | 446/267 |
| 3,748,779 | 7/1973 | Cherk et al. | 446/369 |
| 3,977,121 | 8/1976 | Goldfarb et al. | 446/267 |
| 4,952,190 | 8/1990 | Tarnoff et al. | 273/58 F |
| 5,556,358 | 9/1996 | Scatterday | 482/49 |
| 5,716,303 | 2/1998 | Scatterday | 482/49 |
| 5,718,655 | 2/1998 | Phillips | 482/49 |

*Primary Examiner*—Stephen R. Crow
*Attorney, Agent, or Firm*—Kenneth A. Roddy

[57] ABSTRACT

A process for manufacturing filled resilient double bladder articles wherein a thinner walled resilient outer bladder and thicker walled resilient inner bladder are formed and a lubricating powder layer is deposited on the exterior surface of the inner bladder. The outer bladder is superposed over the inner bladder to form two plies of resilient material separated by the thin layer of lubricating powder which prevents the superposed surfaces from sticking together and allows relative sliding movement therebetween. The superposed bladders are pressed to remove any trapped air between the bladders and are then inflated to radially stretch them as a unit sufficient to cause permanent deformation thereof and thereafter allowed to deflate so that after deflation the deformed superposed bladders are of a size sufficient to contain a predetermined volume of filler material. The double bladder article is filled with a mass of tiny glass spheres having the consistency and appearance of fine powder. The filled article is then heated to radially shrink the superposed bladders tightly around the mass of filler material. The double bladder article is sealed by crimping a wire element around the superposed neck portions of the bladders to form an air tight seal. The sealed article is then cleaned and dried to remove any of the powder-like filler material from its exterior surfaces.

16 Claims, 3 Drawing Sheets

PROCESS FOR MANUFACTURING FILLED DOUBLE BLADDER RESILIENT ARTICLES

BACKGROUND OF THE INVENTION

1. Field of the Invention

This invention relates generally to methods for manufacturing filled resilient and pliable articles, and more particularly to a process for manufacturing double bladder resilient articles containing a mass of tiny glass spheres having the consistency and appearance of a fine powder with a thin layer of lubricating powder disposed between the plies of the resilient bladders.

2. Brief Description of the Prior Art

The present invention is directed toward an improved process for manufacturing filled double bladder resilient articles, such as therapeutic resilient hand exercisers and wrist supports of the type disclosed in my previous U.S. patent applications Ser. No. 08/678,660 and Ser. No. 08/911,295. My previous patent applications do not teach the improved process of forming the inner and outer bladders nor the process of forming a lubricating powder layer between the bladder surfaces which is the subject matter of the present invention.

There are several commercially available resilient hand exercise articles known in the art that are gripped in the palm of the hand and squeezed.

A resilient rubber hand exerciser known as the "Eggserciser"™ is sold by Eggstra Enterprises, Inc., of Alabaster, Ala. This device is an egg-shaped member molded of homogeneous foam rubber.

Other hand exercisers are known which utilize a single or double layer resilient outer covering or bladder filled with sand, seed, grain, or other "granular" or crystalized particles which have flat surfaces and/or sharp points. However, the sharp surfaces or points of the "granular" or crystalized filler material will abrade the interior surface of the resilient bladder and cause premature wear resulting in short product life, and leakage of the filler material.

A pliable hand exerciser sold by Qualatex of Wichita, Kans. under the name "Ad Impressions"™ ASI 78200 is a natural latex balloon filled with hard granular particles having the consistency of sand. The neck of the balloon is tied in a knot. This device has only a single layer of natural latex and the filler material particles are irregular shaped many faceted particles with flat surfaces and sharp edges and range in particle size from about 1/32" to about 3/64". The Qualatex device is firm and hard, has a "crunching" feel when squeezed, has very poor resiliency, and substantially retains a distorted shape after being squeezed.

Therapeutic hand exercisers known as the "Gripp"™ and "Thera-Gripp"™ are sold by Abilitations of Atlanta Ga. These devices resemble a small ball in their natural state and are filled with a material which appears to be yellow seeds or grain, similar to wheat or oats, permanently encased in two layers of natural latex. The filler material particles are oval-shaped with two flat sides, approx. 3/32" in length and 1/32" thick. These devices are relatively firm and hard, have a "crunching" feel when squeezed, and have poor resiliency.

Scatterday, U.S. Pat. No. 5,350,342 discloses a deformable semi-resilient grip having a bladder consisting of a single thick layer, a thin layer surrounded by a thick layer, or a number of thin layers wherein the layers are fixed together which is filled with a mixture of lubricating powder intermixed with filler particles. There is no suggestion of the desirability of providing a lubricating between the walls of the bladders to allow relative movement, instead, they are fixed together.

Tarnoff, U.S. Pat. No. 4,952,190 discloses a deformable novelty toy having a single layer bladder containing a cohesive mixture of low-density microspheres and a small amount of liquid, such as water, mineral oils, glycols, etc., in an amount effective to unite the microspheres and provide cohesion and moldability. Thus, the filler material mixture has a high resistance to relative movement such that the article is capable of absorbing impact energy by deformation, rather than being resilient. This article is provided with a single layer and there is no suggestion of providing double bladders that allow relative movement.

Wrist support devices for supporting the wrist of a person performing repetitive tasks with their wrist, hand and fingers, such as using a computer mouse and typing on a keyboard are also known in the art.

There are several commercially available wrist support devices which consist of a pad formed of neoprene or homogeneous foam rubber that may be attached to a computer mouse or keyboard. These types of wrist supports are relatively stiff and non-compliant to the user's wrist. Other wrist support devices are known which utilize an outer covering or bladder filled with a gel, or with seed, grain, or other "granular" or crystalized particles which have flat surfaces and/or sharp points.

Garcia et al, U.S. Pat. No. 5,228,655 discloses a wrist rest support which includes a base pad that is positioned partially under the keyboard or mouse and a section extending away therefrom that has a top surface for supporting the wrists. In one embodiment the device has detachable foam riser sections which can be substituted to change the height of the wrist supporting section.

Prokop, U.S. Pat. No. 5,566,913 discloses a wrist rest article which can also be squeezed in the hands as an exercise means. This article has an elastic inner envelope formed of a sheet of latex rubber with an outer covering made of Spandex™ I. E. DuPont Company, or other fabric blends. The article is filled with a gelatinous material that supports the wrist and may also be heated or cooled to provide additional therapeutic effects.

Hart, U.S. Pat. No. 5,445,349 discloses a wrist support article made of a flexible tubular cloth container which is filled with particulate material such as rice. The article provides a stable support for the wrist and gently massages the wrist during finger movement, and may also be heated or cooled to provide additional therapeutic effects.

Fuller, U.S. Pat. No. 5,158,255 discloses a generally cylindrical wrist rest article that provides a support for the wrist and can also be grasped and squeezed to function as an exercise means. This article has a tubular solid rigid core that cannot bend surrounded by a yieldable foam layer having an irregular exterior and a soft fabric outer covering.

The prior art articles of the type that are made with a single layer of resilient latex are particularly non-resiliently responsive and tend to be only pliable, rather than resilient, and substantially retain the distorted configuration after being squeezed.

The prior art articles that are formed with a single or double layer resilient bladder filled with sand, seed, grain, or other "granular" or crystalized particles which have flat surfaces and/or sharp points. The sharp surfaces or points of the "granular" or crystalized filler material will abrade the interior surface of the resilient bladder and cause premature wear resulting in short product life, and leakage of the filler material.

The prior art articles of the type that are filled with irregular shaped materials or particles having facets or flat surfaces are uncomfortable to the hand and wrist, are relatively hard, and do not provide a smooth rolling action during wrist movement. If they also function as an exerciser when squeezed, they produce a "crunching" action due to the relative movement between the irregular shaped particle surfaces as they are compressed and displaced and this type of filler material makes them harder to squeeze, or more resistant to squeezing. Whether functioning as a wrist support or exerciser, these types of articles tend to hold their distorted shape for a period of time until the resiliency of the bladder forces the irregular shaped particles to move relative to one another as the device slowly resumes its natural shape. Thus, they are relatively non-resiliently responsive and tend to be only pliable, rather than resilient.

The prior art articles that are formed with a single or double layer resilient bladder filled with sand, seed, grain, or other "granular" or crystalized particles which have flat surfaces and/or sharp points are also prone to premature wear resulting in short product life, and leakage of the filler material due to the sharp surfaces or points of the "granular" or crystalized filler material abrading the interior surface of the resilient bladder.

The present invention is distinguished over the prior art in general, and these patents in particular, by a process for manufacturing double bladder resilient articles containing a mass of tiny glass spheres having the consistency and appearance of a fine powder. The present process provides a layer of lubricating powder disposed between the exterior surface of the inner bladder and interior surface of the outer bladder which prevents the bladder surfaces from sticking together and allows relative sliding movement therebetween. The present process fills the double bladder units with tiny spheres that roll on each other upon squeezing and releasing pressure on the article, thus, the resulting article has very low resistance to relative movement of the particles and allows the article to be compressed quickly and to resume its natural shape quickly due to the resiliency of the superposed bladders and the lubricating powder disposed between the plys, and thereby produces a smooth squishy sensation.

SUMMARY OF THE INVENTION

It is therefore an object of the present invention to provide an improved process for manufacturing filled double bladder resilient articles having lubricating powder layer between the superposed bladder surfaces to provide resiliency, flexibility, compressibility, and strength without excessive wall thickness.

It is another object of this invention to provide an improved process for manufacturing filled double bladder resilient articles having a lubricating powder layer between the superposed bladder surfaces to prevent the surfaces from sticking together and allow them to slide relative to one when the article is compressed, thus reducing wear and friction between the superposed surfaces and extending the life of the article.

Another object of this invention is to provide an improved process for manufacturing filled double bladder resilient articles filled with tiny glass spheres having the consistency of a fine powder wherein the tiny spheres roll on each other as the article squeezed and the pressure is released and thereby providing low resistance to relative movement of the filler material and allowing the article to be compressed quickly and to resume its natural shape quickly.

Another object of this invention is to provide an improved process for manufacturing filled double bladder resilient articles wherein the inner bladder has a thicker wall thickness than the outer bladder and is filled with tiny glass spheres having the consistency of a fine powder with no flat surfaces or sharp edges which would abrade the interior surface of the thicker inner bladder and which significantly reduces or eliminates the problem of filler material abrading the resilient bladder material, and significantly extends the life of the article.

A still further object of this invention is to provide an improved process for manufacturing filled double bladder resilient articles wherein the article is sealed closed with a wire clamp element crimped securely around the neck portion of the bladder in the manner of a sausage clamp on a sausage casing, thus making it difficult to be opened by small children.

Other objects of the invention will become apparent from time to time throughout the specification and claims as hereinafter related.

The above noted objects and other objects of the invention are accomplished by the present process for manufacturing filled resilient double bladder articles wherein a thinner walled resilient outer bladder and thicker walled resilient inner bladder are formed and a lubricating powder layer is deposited on the exterior surface of the inner bladder. The outer bladder is superposed over the inner bladder to form two plies of resilient material separated by the thin layer of lubricating powder which prevents the superposed surfaces from sticking together and allows relative sliding movement therebetween. The superposed bladders are pressed to remove any trapped air between the bladders and are then inflated to radially stretch them as a unit sufficient to cause permanent deformation thereof and thereafter allowed to deflate so that after deflation the deformed superposed bladders are of a size sufficient to contain a predetermined volume of filler material. The double bladder article is filled with a mass of tiny glass spheres having the consistency and appearance of fine powder. The filled article is then heated to radially shrink the superposed bladders tightly around the mass of filler material. The double bladder article is sealed by crimping a wire clamp element around the superposed neck portions of the bladders to form an air tight seal. The sealed article is then cleaned and dried to remove any of the powder-like filler material from its exterior surfaces.

DESCRIPTION OF THE PREFERRED EMBODIMENT

The present invention is directed toward an improved process for manufacturing filled double bladder resilient articles, such as therapeutic resilient hand exercisers and wrist supports of the type disclosed in my previous U.S. patent applications Ser. No. 08/678,660 and Ser. No. 08/911,295. My previous patent applications do not teach the improved process of forming the inner and outer bladders nor the process of forming a lubricating powder layer between the bladder surfaces which is the subject matter of the present invention.

Figure 1:
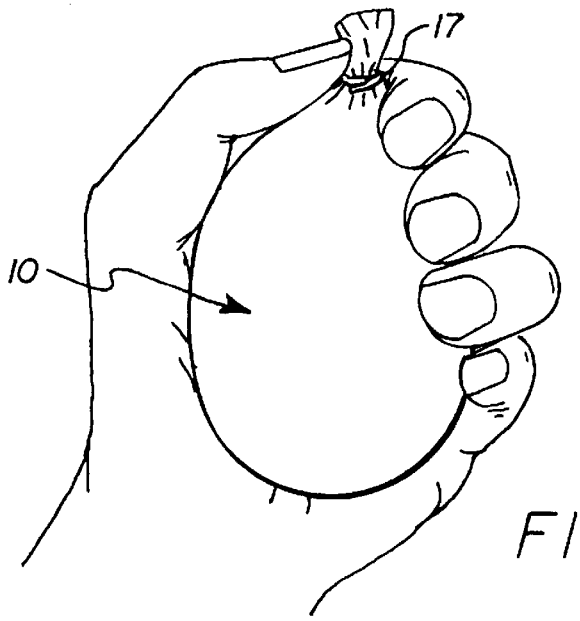
FIG. 1 is a perspective view of a therapeutic resilient hand exerciser manufactured by the process in accordance with the present invention, shown being held in the palm of a hand.
Figure 2:
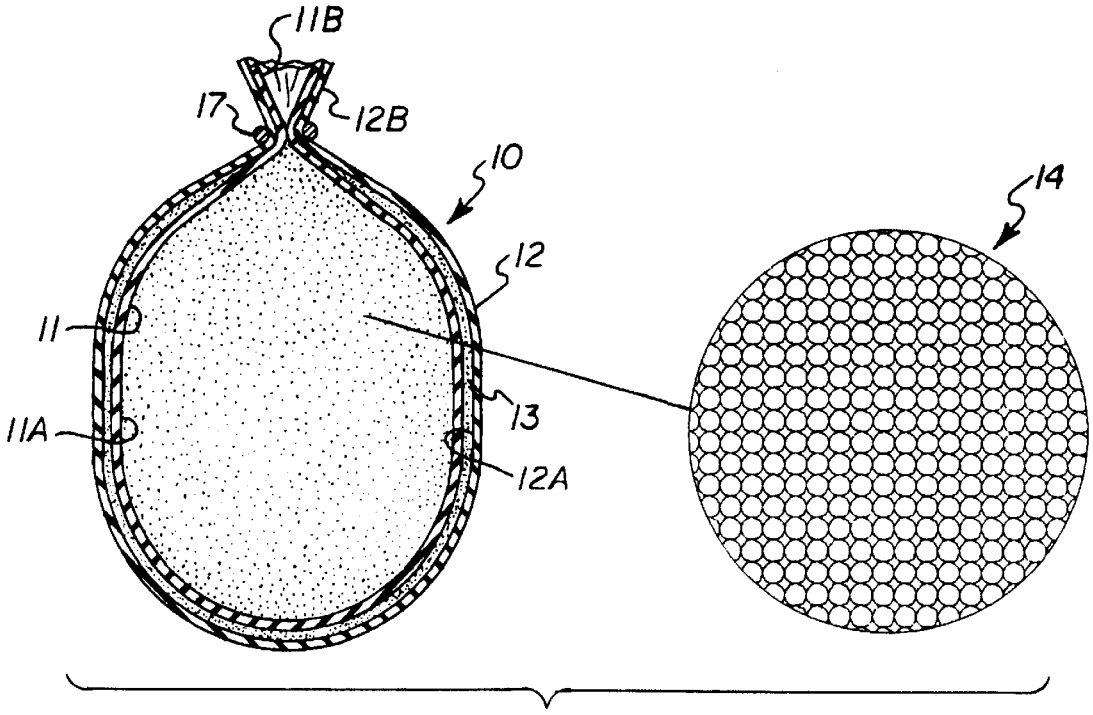
FIG. 2 is a cross sectional view of the therapeutic resilient hand exerciser showing the double bladder and filler material.

Referring to the drawings by numerals of reference, there is shown in FIGS. 1 and 2, a typical filled double bladder article 10 which is manufactured in accordance with the process of the present invention. In the illustrated example, the article 10 is a resilient hand exerciser which in its natural state, as shown in FIG. 1, is a generally oval-shaped member having a diameter of approximately 2¼" and a length of approximately 2½" to fit into the palm of the hand of the user. The exerciser is squeezed and released for exercise and therapy of the muscles of the hand, fingers, and arm and provides a provides a smooth resistance to the squeezing pressure.

As shown in cross section at a larger scale in FIG. 2, the article 10 has an inner bladder 11 and an outer bladder 12 formed of resilient material such as latex rubber. Each bladder 11 and 12 has a main body portion 11A and 12A and a tubular neck portion 11B and 12B, respectively.

As described in detail hereinafter, the inner and outer bladders 11 and 12 are superposed to provide a double layer of resilient material with a thin lubricating layer or coating of talc powder 13 disposed between the exterior of the main body portion 11A and the interior of the main body portion 12A to prevent friction or sticking between the superposed bladder surfaces and allow relative movement therebetween.

The interior of the inner resilient bladder 11 is filled with approximately 5.6 oz. of a powder-like material 14 formed of tiny glass spheres having a particle size ranging from about 70 to about 140 mesh (U.S. standard), which equates to a particle diameter of from about 0.0083" to about 0.0041". The filler material 14 is represented schematically in the drawing figure. In reality, the filler material has the consistency and appearance of a fine white powder. The tiny glass sphere material 14 has a density of about 98 lbs/ft$^3$. The tiny glass spheres are formed of soda-lime glass, or glass oxide. A suitable glass sphere material is manufactured by Potters Industries Inc., of Carlstadt, N.J. and known commercially as "Impact Beads".

MANUFACTURING PROCESS

Referring now to FIGS. 3–12, the steps in the process of forming the resilient inner bladder 11 and resilient outer bladder 12 with a lubricating powder layer will be described followed by a description of the process for assembling and filling the superposed bladders. In a preferred embodiment the wall thickness of the inner bladder 11 is approximately twice the wall thickness of the outer bladder 12. For example, the inner bladder 11 may have a wall thickness of about 0.0015" to about 0.0030" and the outer bladder may have a wall thickness of about 0.0010" to about 0.0015".

Formation of The Inner Bladder

Figure 3:
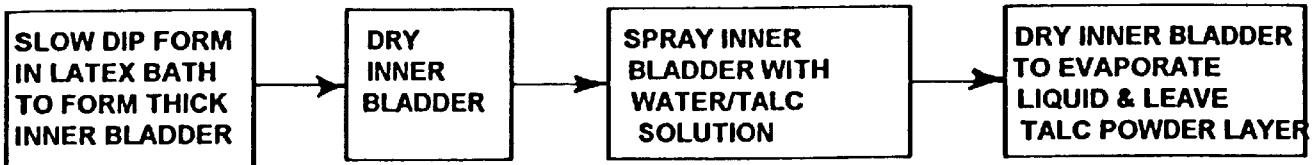
FIG. 3 is a block diagram illustrating the steps in the process of forming the inner resilient bladder in accordance with the present invention.

As represented in block diagram in FIG. 3, a mold or former of the preferred shape, for example an inverted bulbous light bulb configuration, is coated with a coagulant such Dicalite 104 (a commercially available fresh water diatmaceous earth coagulant material). The inner bladder 11 is formed by slowly dipping the coagulant coated former in a bath of prevulcanized liquid latex at a rate sufficient for a layer of latex having the desired wall thickness to collect on the former. The latex layer is then dried by hot air to form the inner bladder. After drying, and while still on the former, the inner bladder is sprayed with aqueous water/talc solution and then again dried by hot air to evaporate the liquid faction of the solution on the bladder and leave a thin lubricating talc powder layer 13 on the bladder.

A preferred water/talc solution comprises from about 80% to about 95% by weight of water and from about 5% to about 20% by weight of finely ground magnesium silicate (talc).

After the thin lubricating talc powder layer 13 has been deposited on the inner bladder, it is removed from the former. At this stage the coated exterior surface of the inner bladder is very slick and has a greasy feel. This facilitates placing the outer bladder 12 over the inner bladder 11, as described hereinafter.

Formation of Outer Bladder

Figure 4:
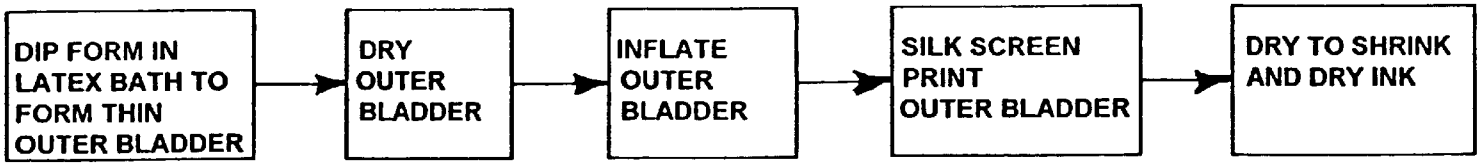
FIG. 4 is a block diagram illustrating the steps in the process of forming the resilient outer bladder in accordance with the present invention.

As represented in block diagram in FIG. 4, the outer bladder 12 is formed by dipping a coagulant coated former of same size and shape as used for the inner bladder in the prevulcanized liquid latex bath at a rate sufficient for a layer of latex having a wall thickness approximately one-half as thick as the wall thickness of the inner bladder to collect on the former. The thinner latex layer is then dried by hot air to form the outer bladder 12.

If the outer bladder 12 is to silkscreened, it is placed on a nozzle and inflated to about 80% of its capacity. While in the inflated condition, it is screen printed with ink in a conventional commercially available balloon silk screening press. After it has been silk screened, it is dried in a rotating drum hot air dryer to shrink it back approximately to its original size. This step also dries the ink, brings out the color of the ink used, and sharpens the ink image.

Assembly and filling

Figure 5:
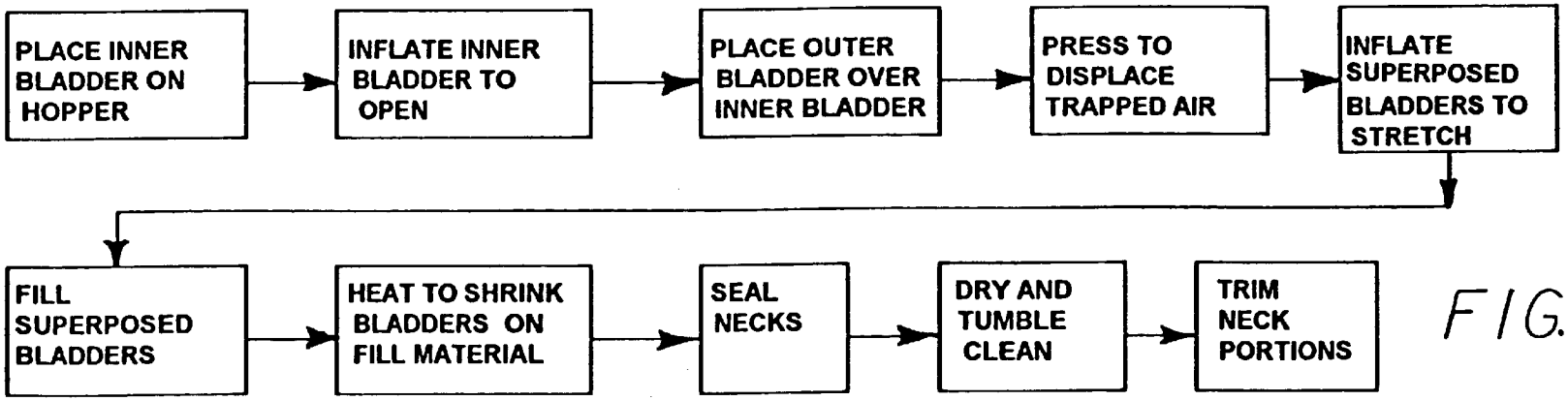
FIG. 5 is a block diagram illustrating the steps in the process of assembling and filling the double bladders in accordance with the present invention.
Figure 6:
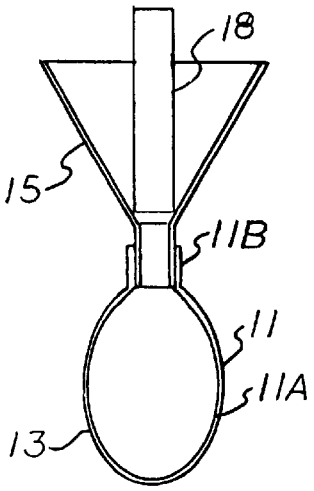
FIGS. 6 though 12 illustrate somewhat schematically, the steps in the process of assembling and filling a double bladder resilient article in accordance with the present invention.

Referring now to the block diagram of FIG. 5 and the schematic illustrations of FIGS. 6–12, the neck portion 11B of the inner resilient bladder 11 having a thicker wall and a slick talc powder coating 13 on its exterior surface is installed on the open bottom end of a funnel or hopper 15 (FIG. 6) and biasly retained thereon by its resiliency.

An air nozzle 18 is placed into the funnel or hopper 15 and the inner bladder 11 is inflated to straighten it on the funnel or hopper and to open it up in the event that its interior surfaces may have become stuck together during the drying operation.

Figure 7:
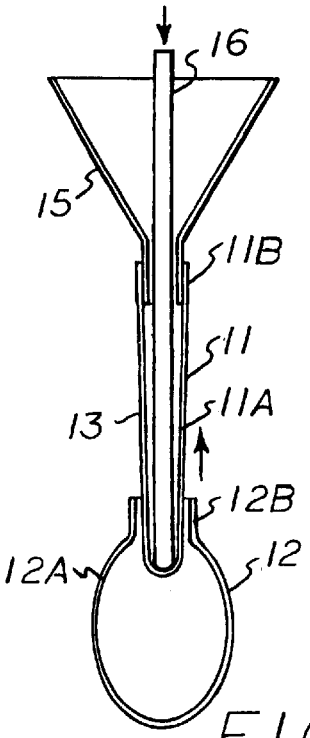

A dowel 16 is inserted through the interior of the hopper 15 and into the inner resilient bladder 11 to push its bottom end downwardly thereby stretching the inner bladder 11 longitudinally so that it becomes radially narrower than the interior diameter of the neck portion 12B of the outer bladder 12 (FIG. 7).

The outer resilient bladder 12 is installed over the longitudinally extended inner resilient bladder 11 in superposed relation with its neck portion 12B surrounding and biasly engaged on the neck portion 11B of the first resilient bladder 11 (FIG. 7). After the outer bladder 12 is installed, the rod or dowel 16 is withdrawn. Air may become trapped between the superposed bladders at this stage.

Figure 8:
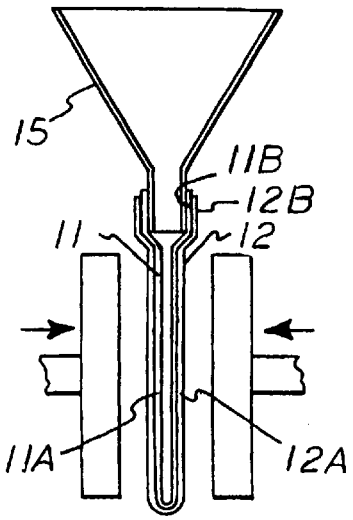
Figure 9:
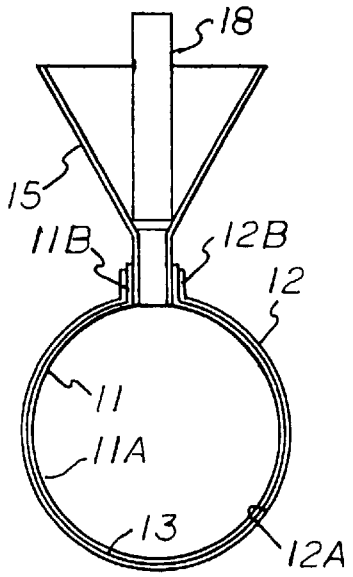

The superposed inner and outer resilient bladder unit is then laterally pressed to drive air out of the space between the exterior of the inner resilient bladder 11 and the interior of outer resilient bladder 12 (FIG. 8).

After being pressed, an air nozzle 18 is placed into the hopper 15 and air is introduced into the interior of the inner resilient bladder 11 to inflate the superposed body portions 11A and 12A of the inner and outer resilient bladders 11 and 12 as a unit to approximately 90% to 95% capacity (FIG. 9) and then the air is removed so that the unit deflates. This step will radially stretch the superposed bladders as a unit sufficient to cause deformation thereof and after deflation the deformed superposed bladders are of a size sufficient to contain a predetermined volume of filler material. For example, after stretching, the superposed bladder unit may be from about 2 to about 2½ greater than its original size.

Figure 10:
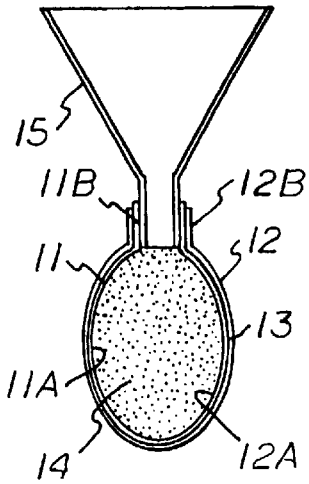

The interior of the inner resilient bladder 11 is then filled with a volume of the previously described tiny glass sphere material 14 having the consistency of fine powder to slightly expand the superposed body portions 11A and 12A of the inner and outer resilient bladders 11 and 12 (FIG. 10). In a preferred embodiment, approximately 5.6 oz. of the powder-like material 14 is used to fill the superposed bladder unit.

Figure 11:
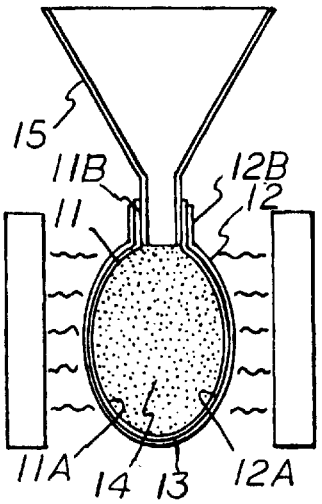

The superposed inner and outer resilient bladder unit now filled with the powder-like tiny glass sphere material 14 is then passed through a heat tunnel and subjected to hot air to radially shrink the superposed layers around the mass of powder-like tiny glass sphere material 14, and remove air from the powder-like mass and from between the superposed layers of resilient material (FIG. 11). After shrinking, the filled superposed bladder unit is tight and firm to the touch.

The superposed neck portions 11A and 12A of the inner and outer resilient bladders 11 and 12 are removed from the bottom end of the funnel or hopper 15, and inserted into a pneumatic clamp crimping machine.

Figure 12:
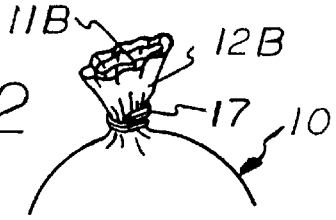

The clamp crimping machine is actuated to secure a wire clamp element 17 transversely around the superposed neck portions 11B and 12B to seal the open end of the bladders (FIG. 12). It should be noted that wire staple 17 does not penetrate the resilient material, but is crimped around the neck portions 11B and 12B in the manner of a sausage clamp on a sausage casing.

A quantity of the sealed resilient double bladder units are placed in a rotating drum hot air dryer and tumbled for a period of time sufficient to clean and dry them and remove any powder-like tiny glass spheres from their exterior surfaces.

After cleaning and drying, the superposed neck portions 11A and 12A of the inner and outer resilient bladders 11 and 12 may be cut off to trim them to a desired length.

The improved process for manufacturing the filled double bladder resilient articles produces articles having a resilient thicker inner bladder and a resilient thinner outer bladder which provides resiliency, flexibility, compressibility, and strength without excessive wall thickness. The lubricating layer of talc powder 13 between the bladder surfaces prevents the resilient surfaces from sticking together and allows the them to slide relative to one another when the device is squeezed and released. This feature prevents wear or friction between the walls of the bladders and extends the life of the article.

The powder-like filler material 14 is formed of tiny glass spheres which roll on each other as the article is squeezed and the pressure is released. Thus, the filler material 14 has a low resistance to relative movement. This feature allows the article to be compressed quickly and to resume its natural shape quickly when the resiliency of the double wall bladder forces the device to resume its natural shape.

The combination of the resilient double bladder with the lubricating talc powder layer between the bladder walls and the powder-like tiny glass spheres which roll on each other as the device is squeezed and released give the article a unique smooth "squishy" feeling when squeezed and released, and makes it more resiliently responsive than prior art articles manufactured by other processes and filled with sand, seed, grain, or other "granular" or crystalized material which have flat surfaces and/or sharp points.

While this invention has been described fully and completely with special emphasis upon a preferred improved process, it should be understood that within the scope of the appended claims the invention may be practiced otherwise than as specifically described herein.

What is claimed is:

1. A process for manufacturing filled resilient double bladder articles comprising the steps of:

providing a resilient outer bladder formed of resilient material having a first wall thickness and an interior and exterior surface;

providing a resilient inner bladder formed of resilient material having a second wall thickness greater than the wall thickness of said outer bladder and an interior and exterior surface;

providing a thin layer of lubricating powder on said inner bladder exterior surface;

superposing said outer bladder on said inner bladder to form two plies of resilient material separated by said thin layer of lubricating powder to prevent the superposed surfaces from sticking together and allow relative sliding movement therebetween;

filling said inner bladder with a mass of filler material having the consistency and appearance of fine powder; and sealing said superposed inner and outer bladders to surround said mass of filler material.

2. The process according to claim 1 wherein said step of providing said outer bladder comprises the steps of:

dipping a coagulant coated former having the shape of said outer bladder in a pre-vulcanized liquid latex bath at a rate sufficient for a layer of latex of said first wall thickness to collect on said former;

drying said layer of liquid latex to form said outer bladder; and thereafter removing said outer bladder from said former.

3. The process according to claim 2 wherein said step of providing said inner bladder comprises the steps of:

dipping a coagulant coated former having the shape of said inner bladder in a pre-vulcanized liquid latex bath at a rate sufficient for a layer of latex of said second wall thickness to collect on said former;

drying said layer of liquid latex to form said inner bladder; and thereafter removing said inner bladder from said former.

4. The process according to claim 3 wherein said step of dipping said former having the shape of said inner bladder in a liquid latex bath is carried out at a rate sufficient for a layer of latex having a thickness approximately twice the wall thickness of said outer bladder to collect on said former.

5. The process according to claim 3 wherein said step of providing a thin layer of lubricating powder on said inner bladder exterior surface comprises the steps of:

after drying said layer of liquid latex to form said inner bladder and prior to removing said inner bladder from said former;

dipping said inner bladder formed on said former in an aqueous solution containing water and talc;

drying said inner bladder formed on said former to evaporate the liquid faction of said aqueous solution and leave a thin talc powder layer on said inner bladder exterior surface.

6. The process according to claim 1 wherein said inner and said outer resilient bladders each have a central body portion and a neck portion; and said step of superposing said outer resilient bladder on said inner resilient bladder comprises the steps of;

installing the neck portion of said inner resilient bladder on the open bottom end of a hopper;

inserting a dowel through the interior of said hopper and said inner bladder neck portion to engage the bottom end of said dowel on the bottom of said inner bladder interior to stretch said inner bladder longitudinally and narrow it radially;

installing said outer bladder over said stretched inner bladder in superposed relation with said outer bladder neck portion surrounding said inner bladder neck portion, and thereafter withdrawing said dowel.

7. The process according to claim 6 including the additional steps of prior to inserting said dowel;

momentarily inflating said inner bladder to open it up and straighten it on said hopper.

8. The process according to claim 6 including the further step of after withdrawing said dowel, pressing said superposed inner and outer bladders to drive air out of the space between the exterior surface of said inner bladder and the interior surface of said outer bladder.

9. The process according to claim 8 including the further step of after driving air out of the space between the exterior of said inner bladder and the interior of said outer bladder;

introducing a blast of air into the interior of said inner bladder to inflate and radially stretch said superposed bladders as a unit sufficient to cause permanent deformation thereof and thereafter allowing the deformed superposed bladders to deflate; such that after deflation said deformed superposed bladders are of a size sufficient to contain a predetermined volume of said filler material.

10. The process according to claim 9 wherein said superposed bladders are inflated and radially stretched as a unit sufficient to cause permanent deformation thereof such that after deflation, said deformed supperposed bladders are of a size of from about 2 to about 2½ greater than their original size.

11. The process according to claim 9 including the further step of:

after said superposed bladders are inflated and radially stretched as a unit sufficient to cause permanent deformation thereof; and after filling the interior of said inner resilient bladder with said filler material;

heating said deformed superposed bladders sufficient to radially shrink said central body portions tightly around said mass of filler material.

12. The process according to claim 6 wherein said step of sealing said superposed inner and outer resilient bladders comprises crimping a wire clamp element around said inner bladder neck portion and surrounding neck portion of said outer bladder to form an air tight seal.

13. The process according to claim 1 including the further steps of cleaning and drying said sealed superposed inner and outer resilient bladders.

14. The process according to claim 1 wherein said step of filling said inner bladder comprises filling said inner bladder with a mass of tiny glass spheres formed of glass oxide (soda-lime glass) having the consistency and appearance of a fine powder.

15. The process according to claim 1 wherein said step of filling said inner bladder comprises filling said inner bladder with a mass of tiny spheres having a particle size ranging from about 70 to about 140 U.S. standard mesh (about 0.0083" dia. to about 0.0041" dia.) and having the consistency and appearance of a fine powder.

16. The process according to claim 1 wherein said step of filling said inner bladder comprises filling said inner bladder with a mass of tiny spheres having a particle size ranging from about 70 to about 140 U.S. standard mesh (about 0.0083" dia. to about 0.0041" dia.) and a density of about 98 lbs/ft$^3$.

* * * * *